US006793319B2

(12) United States Patent
Ikemoto et al.

(10) Patent No.: US 6,793,319 B2
(45) Date of Patent: Sep. 21, 2004

(54) PRINTER AND PRINTER HEAD

(75) Inventors: Yuichiro Ikemoto, Kanagawa (JP); Kazuyasu Takenaka, Kanagawa (JP); Makoto Ando, Tokyo (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/910,617

(22) Filed: Jul. 20, 2001

(65) Prior Publication Data

US 2002/0057309 A1 May 16, 2002

(30) Foreign Application Priority Data

Jul. 25, 2000 (JP) ..... P2000-229050
Jun. 5, 2001 (JP) ..... P2001-169000

(51) Int. Cl.[7] ..... B41J 2/145; B41J 2/15; B41J 29/38

(52) U.S. Cl. ..... 347/40; 347/9; 347/12

(58) Field of Search ..... 347/42, 40, 12

(56) References Cited

U.S. PATENT DOCUMENTS 5,469,199 A * 11/1995 Allen et al. ..... 347/42
5,600,354 A * 2/1997 Hackleman et al. ..... 347/50
5,605,659 A 2/1997 Moynihan et al. ..... 264/430
5,771,052 A 6/1998 Hine et al. ..... 347/42
5,900,892 A 5/1999 Mantell et al.
6,250,738 B1 * 6/2001 Waller et al. ..... 347/42

FOREIGN PATENT DOCUMENTS

| | | |
|---|---|---|
| EP | 0034060 | 8/1981 |
| EP | 0352468 | 1/1990 |
| EP | 0677388 | 10/1995 |
| EP | 0773108 | 5/1997 |
| EP | 0786342 | 7/1997 |
| EP | 0914950 | 5/1999 |
| EP | 0968832 | 1/2000 |
| EP | 1000746 | 5/2000 |
| JP | 11-300962 | 11/1999 |
| WO | 98/42514 | 10/1998 |

* cited by examiner

*Primary Examiner*—Thinh Nguyen
(74) *Attorney, Agent, or Firm*—Sonnenschein, Nath & Rosenthal LLP

(57) ABSTRACT

A printer head with overlapping nozzles. A plurality of head chips are formed in an array pattern on the printer head wherein a plurality of nozzles are associated with each head chip. Nozzles associated with one head chip and nozzles associated with an adjacent head chip partly overlap to form an overlapped area. When an ink-ejecting mechanism drives across a print object, the nozzles of the one head chip and the nozzles of the adjacent head chip respectively eject inks which are mixed in the overlapped area to reduce dot density differences on the print object.

10 Claims, 20 Drawing Sheets

PRINTER AND PRINTER HEAD

RELATED APPLICATION DATA

The present application claims priority to Japanese Applications Nos. P2000-229050 filed Jul. 25, 2000, and P2001-169000 filed Jun. 5, 2001, which application is incorporated herein by reference to the extent permitted by law.

BACKGROUND OF THE INVENTION

1. Field of the Invention

The present invention relates to a printer and printer head, and more particularly, to a line printer using an ink-jet method.

2. Description of the Related Art

Conventionally, ink-jet printers have been designed to print a desired image, characters and so on by ejecting ink droplets onto the paper selectively by the nozzles placed sequentially in a direction substantially perpendicular to the paper-feed direction.

In such a line printer, a thermal-method printer for example, as disclosed in Japanese Unexamined Patent Application Publication No. 2001-71495, head chips are used to form a printer head in order to improve yield and to avoid influence of wiring resistance. In this case, the head chip is formed such that ink is held in ink bed, and is heated by a heater to eject ink droplets from the nozzles. The head chip is made of one semiconductor substrate on which heaters and so on are created for a plurality of such nozzles. In a printer, a plurality of such head chips are placed to form a line head, for example, thereby making it possible to simplify the total configuration.

However, a printer head consisting of such head chips in a conventional fabrication has various problems described below, thereby having defects for full practical use.

A first problem among the above will be described below, which is to be solved by the present invention. This problem is that, for these head chips, irregularity of the characteristics cannot be prevented. If the irregularity is large, as shown in FIG. 29, on the boundary of the ranges that are covered by the head chips 1A and 1B, which are placed adjacently, there appears dot-density difference of the printout between the ranges covered by the head chips 1A and 1B, respectively. Thus, for example, when printing a background in a single color, a phenomenon occurs that on the boundary part, there appear vertical stripes in the direction of printout, deteriorating quality of the print result.

Next, a second problem with a printer head in a conventional fabrication will be described below, which is to be solved by the present invention. In this connection, deterioration of print result when using an ink-jet printer is caused not only by the above-mentioned irregularities of head chips, but also by positioning errors of head chips.

For an ink-jet printer, high quality print result is required, so that printing has been performed using small droplets with high density in these years. However, when using the same color ink-droplets, if deviation of an impact point from a target point is more than a half of a dot diameter, deterioration of print quality is detected. This means that nozzles need to be positioned with high precision, otherwise a positioning error affects an impact point of an ink droplet. In this connection, when a dot 40 $\mu$m in diameter is created by adhering an ink droplet onto a paper to secure print result of 600 dpi, a positioning error of a dot is allowed by not more than 20 $\mu$m for the same color ink-droplets.

Therefore, in a printer, even if irregularity of the characteristics of head chips is prevented for practical use, when aligning a plurality of head chips to form a printer head in a conventional fabrication, head chips need to be aligned with very high precision, which is practically difficult, thereby making it inevitable to deteriorate print result.

Specifically, as shown in FIG. 30, for example, when placing the head chips 30A to 30D in alignment to form a printer head, the head chips 30A to 30D are usually placed in alternate shift in the direction of feeding paper, thereby making it possible to place the nozzles at regular intervals in the direction of alignment of the head chips 30A to 30D. In such placement of head chips, misplacement may occur as shown in FIGS. 31, 32 and 33.

In the case as shown in FIG. 31, the head chip 30C is misplaced in the direction of alignment of head chips. In this case, at the boundaries of the misplaced head chip 30C and the adjacent head chips 30B and 30D, nozzle pitches are not uniform, thereby resulting in print irregularity with stripes in the direction of paper feed in the same manner as described above as in FIG. 29.

In the case as shown in FIG. 32, the head chip 30B is misplaced in the direction of paper feed. In this case, the nozzles of the head chip 30B are misplaced just as the misplacement of the head chip in the direction of paper feed, thereby resulting in a situation that, for example, when printing a straight line in a lateral direction, a step-wise output will be produced.

In the case as shown in FIG. 33, the head chip 30D is placed inclining, thereby resulting in a situation that, for example, when printing a straight line in lateral direction, a bended line will be produced. Moreover, as viewed from the paper feed direction, the nozzle pitches of the head chip 30D are shorter due to the inclination of the head chip, more particularly, the nozzle pitch suddenly changes at the boundary of the adjacent head chip 30C, thereby resulting in deterioration of uniformity of the print result. In this connection, deterioration of the print result is significant when printing a line image in the paper feed direction.

Additionally, quality deterioration of print result due to positioning error of head chips occurs when printing in different colors, which is detected as deterioration of registration and reproducibility in color.

Normally, when printing an image in color, ink droplets of yellow, magenta, cyan and black are adhered onto a paper. Corresponding to this, as shown FIGS. 34 to 36, for a printer head printing an image in color, alignment of head chips is formed for each color, that is, Y for yellow, M for magenta, C for cyan and B for black. In FIGS. 34 to 36, arrays of the head chips 30A to 30D shown in FIGS. 30 to 33 are indicated as rectangular forms for simplicity.

When placing these arrays of head chips, misplacement may occur as shown in FIGS. 34 to 36. FIG. 34 shows the case where an array of particular color head chips is misplaced in the direction of the head chip arrays. In this case, the image of the color assigned to the misplaced head chip array (M for magenta in the case of FIG. 34) will be printed with some displacement in lateral direction compared with the image of other colors.

In the case as shown in FIG. 35, a head-chip array of particular color (the head chip array of Y for yellow in this case) is misplaced in the direction of placing head chip arrays. In this case, the image of the color assigned to a misplaced head chip array will be printed with some displacement in the paper feed direction compared with the image of other colors.

In the case as shown in FIG. 36, an array of particular color head chips is inclined (the head chip arrays M for magenta, C for cyan and K for black in this case). In this case, the image of the color assigned to the inclined head chip array will be printed as twisted compared with the image of other colors.

In this connection, misplacement of dots in different colors is not so severely observed as in the case of the same color, but will be detected if displacement is approximately 100 $\mu$m.

SUMMARY OF THE INVENTION

In order to solve the above-mentioned problem, according to a first aspect of the present invention, there is provided a printer, wherein some of the plurality of nozzles allocated to one head chip are placed so as to be partly overlapped with a plurality of nozzles allocated to the adjacent head chips at the adjacent head chips, as viewed from the direction of feeding a print object, in order for ink droplets to be adhered to almost the same point.

With this arrangement, it is possible to print, by either of the head chips, the area overlapped by both adjacent head chips. Therefore, for example, by mixing dots of each head chip, or by making it variable to set the boundary of the overlapping area, it is possible to make unnoticeable the difference of the print result caused by the head chips of irregular characteristics.

According to a second aspect of the present invention, there is provided a printer, including a nozzle plate made of one thin plate, on which a plurality of nozzles are placed to form a nozzle array.

With this arrangement, the nozzles can be made with high positioning precision. Thus, even if the head chips are misplaced, the nozzles are prevented to be misplaced, thereby preventing positioning error of making a dot due to positioning errors of the head chips. As a result, it is possible to prevent deterioration of the print result due to positioning errors of dots.

According to a third aspect of the present invention, there is provided a printer, in which the nozzles are formed on the nozzle plate made of one thin plate, as many nozzles as necessary for a plurality of the head chips are formed, and a plurality of head chips are placed on the nozzle plate to form the head.

With this arrangement, the nozzles can be made with high positioning precision. Thus, even if the head chips are misplaced, the nozzles are prevented to be misplaced, thereby preventing positioning error of making a dot due to the positioning error of the head chips. As a result, it is possible to prevent deterioration of the print result due to the positioning errors of dots.

According to a fourth aspect of the present invention, there is provided a printer including a nozzle plate made of one thin plate, in which a plurality of nozzle arrays each which comprises a plurality of the nozzles are formed corresponding to the plurality of colors on the nozzle plate.

With this arrangement, it is possible to print by ejecting ink droplets from the nozzle arrays made of nozzles with high precision. Thus, for each color, prevention is made for positioning error of making a dot due to the positioning error of the head chips. As a result, it is possible to prevent deterioration of the print result due to the positioning errors of dots.

According to a fifth aspect of the present invention, there is provided a printer, in which as many nozzles as necessary for head chips of a plurality of colors are formed on a nozzle plate made of one thin plate, and a plurality of head chips necessary for a plurality of colors are placed on the nozzle plate to form the head.

With this arrangement, it is possible to print by ejecting ink droplets from the nozzle arrays made of nozzles with high precision. Thus, for each color, prevention is made for positioning error of making a dot due to the positioning error of the head chips. As a result, it is possible to prevent deterioration of the print result due to the positioning errors of dots.

According to a sixth aspect of the present invention, there is provided a printer head, in which the head chips are placed in such a manner that some nozzles allocated to the head chips are partly overlapped at the adjacent head chips, as viewed from the direction of feeding a print object.

With this arrangement, it is possible to provide a printer head that can prevent deterioration of the print result due to irregularities of head chips.

According to a seventh aspect of the present invention, there is provided a printer head including a nozzle plate made of at least one thin plate, in which nozzle arrays comprising a plurality of the nozzles are formed on the nozzle plate.

With this arrangement, it is possible to provide a printer head that can prevent deterioration of the print result due to positioning errors of head chips.

According to a eighth aspect of the present invention, there is provided a printer head in which nozzles are formed on a nozzle plate made of one thin plate, as many nozzles as necessary for a plurality of the head chips are formed, and a plurality of head chips are placed on the nozzle plate to form a head.

With this arrangement, it is possible to provide a printer head that can prevent deterioration of the print result due to positioning errors of head chips.

According to a ninth aspect of the present invention, there is provided a printer head including a nozzle plate made of at least one thin plate, in which a plurality of nozzle arrays each of which comprises a plurality of nozzles are formed corresponding to a plurality of colors on the nozzle plate.

With this arrangement, in a plurality of colors, it is possible to provide a printer head that can prevent deterioration of the print result due to positioning errors of head chips.

According to a tenth aspect of the present invention, there is provided a printer head in which nozzles are formed on a nozzle plate made of one thin plate, as many nozzles as necessary for a plurality of head chips for a plurality of colors are formed, and a plurality of head chips necessary for a plurality of colors are placed on said nozzle plate to form the head.

With this arrangement, in a plurality of colors, it is possible to provide a printer head that can prevent deterioration of the print result due to positioning errors of head chips.

DETAILED DESCRIPTION OF THE PREFERRED EMBODIMENTS

Embodiments of the present invention will now be described in detail with reference to the accompanying drawings.

(1) A First Embodiment (1-1) The configuration of a first embodiment

Figure 2:
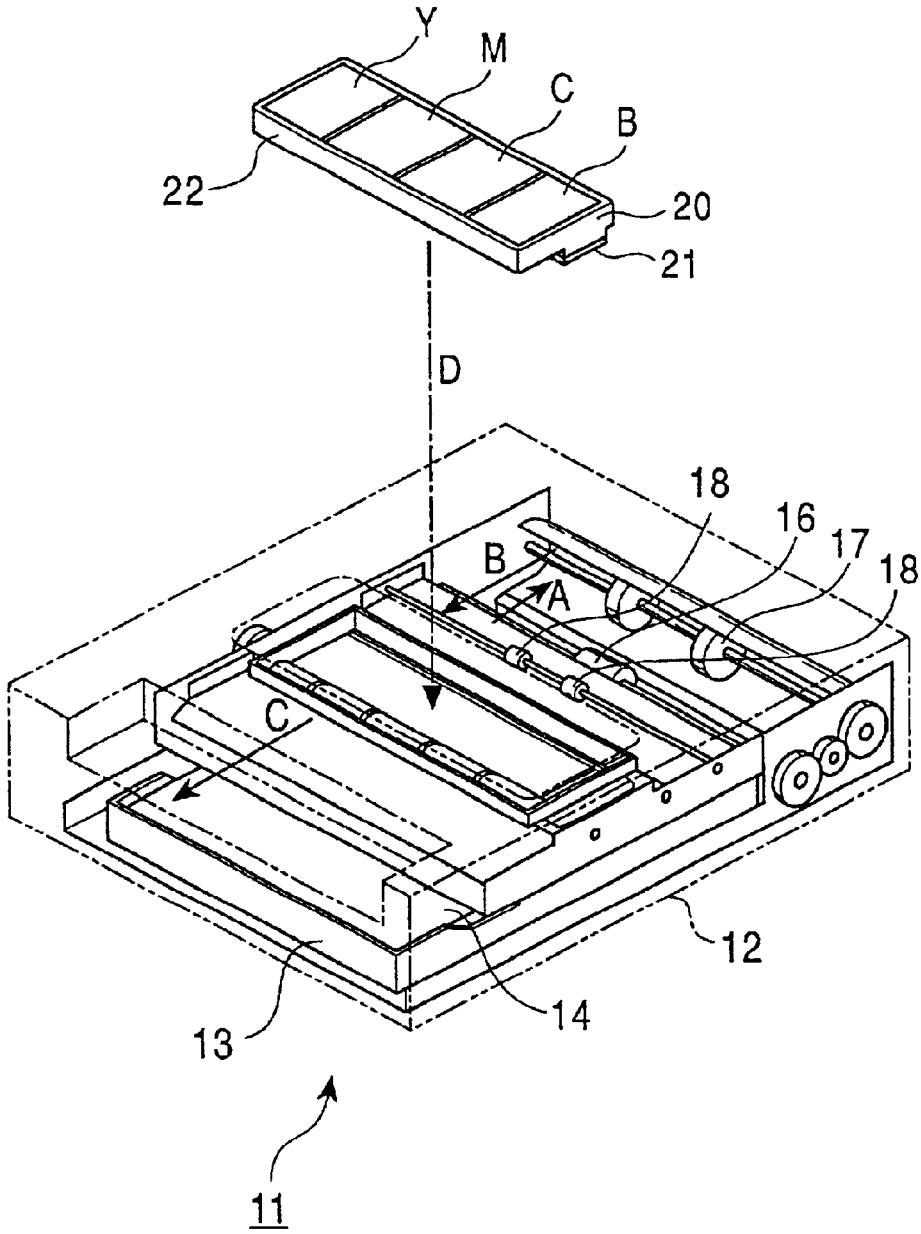
FIG. 2 is a perspective view of a line printer comprising the head chips shown in FIG. 1.

FIG. 2 is a perspective view of a line printer in accordance with the first embodiment of the present invention. The line printer 11 is contained and assembled in the rectangular housing 12 on the whole, and the paper tray 13 holding the paper 14 is to be mounted at tray entrance equipped at the front side of the housing 12 to feed the paper 14.

When the paper tray 13 is mounted on the line printer from the tray entrance, the paper 14 is pressed by the paper-feed roller 16 in the predetermined mechanism, and by rolling the roller 16, as shown by the arrow A, the paper 14 is guided out from the paper tray 13 in the direction to the rear side. The line printer 11 includes the reversal roller 17 on the paper-feed side. By rolling with the reversal roller 17, as shown in the arrow B, the paper guide direction is switched to the front-side direction.

In the line printer 11, the paper 14, which is switched by the feed direction in such a manner, is guided by the spurring roller 18 and so on such that the paper traverses over the paper tray 13. And as shown in the arrow C, the paper is ejected from the outlet placed at the front side. In the line printer 11, between the spurring roller 18 and the outlet, as shown by the arrow D, the head cartridge 20 is placed in an exchangeable way.

The head cartridge 20 comprises the head 21 placed beneath the holder 22 having the predetermined form, in which respective line heads yellow, magenta, cyan and black, are placed. In the holder 22, the ink cartridges Y, M, C and B are to be placed respectively. Thus, the line printer 11 can print an image and so on by ejecting each color ink to be adhered onto the paper 14 from the corresponding line head.

Figure 3:
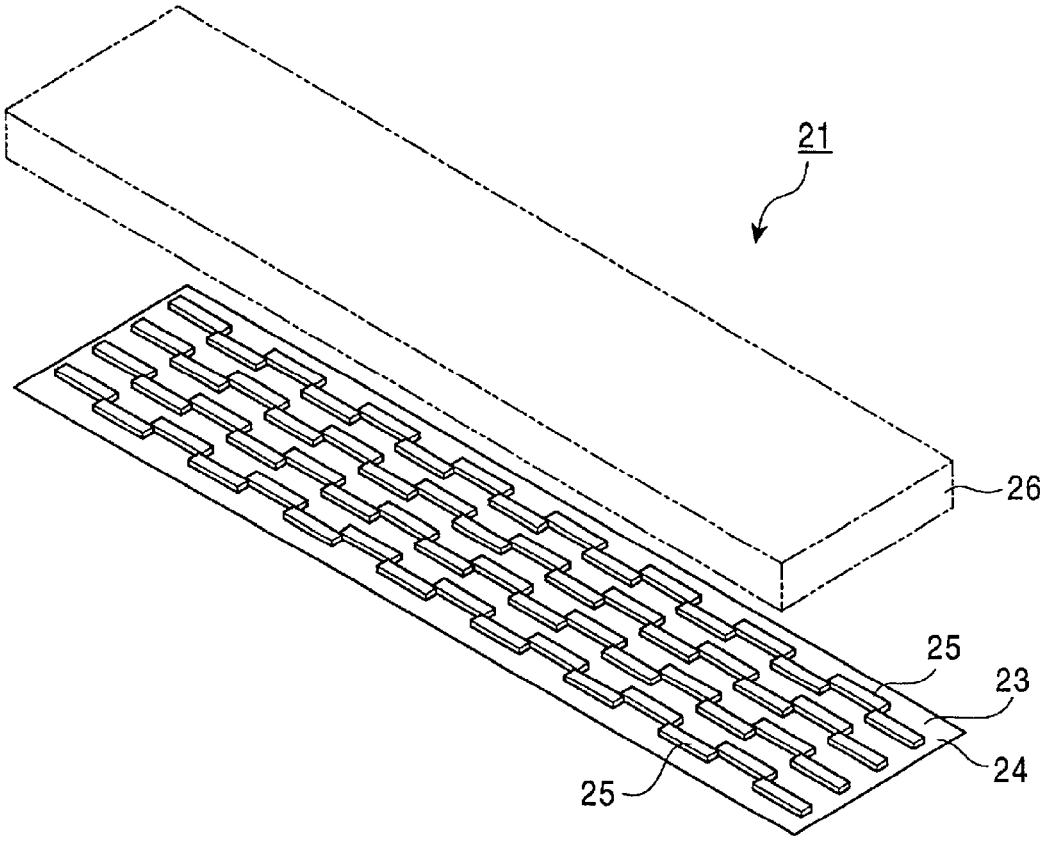
FIG. 3 is an exploded perspective view of the head applied to the line printer in FIG. 2.

FIG. 3 is an exploded perspective view as viewed from the same direction as in FIG. 2. As shown in FIG. 3, the head 21 includes an orifice plate 23, which is, for example, composed of a sheet made of carbonic resign, on which nozzles and so on are made. The orifice plate 23 is supported by the frame not shown in the view. Moreover, the head 21 includes the dry film 24 made of the same carbonic resign in a predetermined shape which is placed on the orifice plate 23, and then the head chips 25 are placed sequentially.

The head 21 comprises the head chips 25 placed in 4 lines, each of which corresponds to printing yellow, magenta, cyan and black colors, and which are placed across the paper 14 to form a line head. Thereafter, to the head 21, the metallic plate 26 is attached, which is fabricated to have a corrugated surface on the side of the head chips 25, and then each of the head chip 25 is connected.

Figure 4:
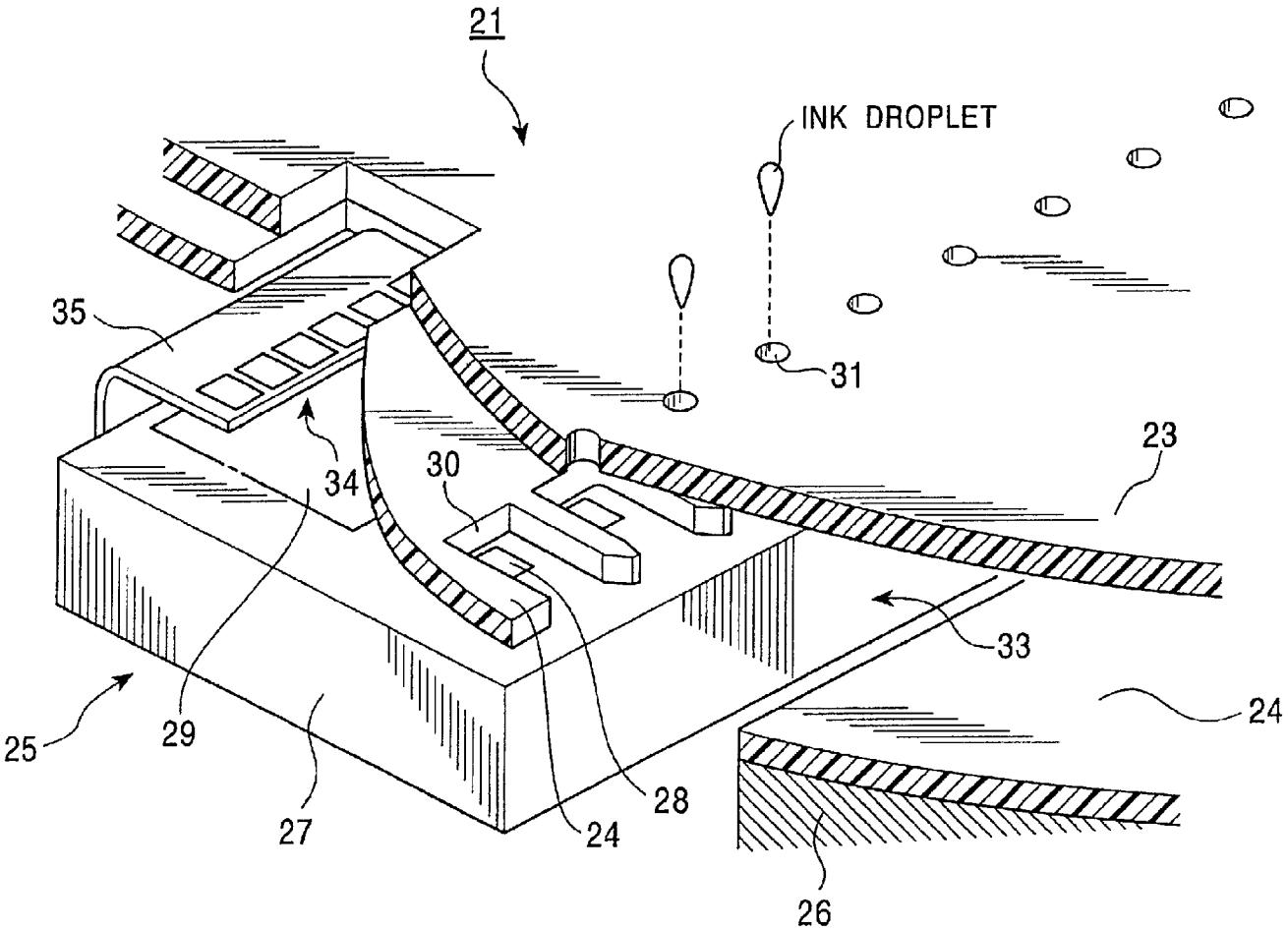
FIG. 4 is a perspective view showing the head in FIG. 3 in detail.

FIG. 4 is a section view showing, together with the surrounding structure, the head chip 25 to be assembled to the head 21 in such a manner. The head chip 25 is made from a silicon substrate 27 fabricated by integrated circuit technology, which is formed such that the heaters 28 for heating the ink are placed sequentially, and the drive circuit 29 is formed to drive the heaters 28. The head 21 is fabricated to have the orifice plate 23 such that openings with circular shape in cross-section are placed on each heater 28. Also, the dry film 24 is placed to form a septum and so on for each heater 28, thereby making ink droplet bed 30 for each heater 28, and the orifice plate 23 is used to eject ink droplets to form the nozzles 31.

On the head chip 25, such a heater 28 is placed near the side, on which the dry film 24 is formed to have a comb-teeth shaped septum in order to expose the ink bed 30. On the head 21, the metallic plate 26 and the dry film 24 form the ink-flow path 33 in order to guide ink in the ink cartridge Y, M, C, and B from the exposed side. Thus, the head 21 is made such that ink is guided from the edge side in the longitudinal direction of the head chip 25 into each ink bed 30 of each heater 28.

Moreover, on the head chip 25, at the opposite side where the heater 28 is placed, the pad 34 is formed to drive the circuit by connecting flexible wiring substrate 35. By these components, in the head 21, an ink-ejecting mechanism is formed, by which ink droplets are ejected from the nozzles 31, including the heater 28, ink-drop bed 30 and nozzle 31. The head chip 25 includes the heaters 28 placed sequentially, which is a part of the ink-ejecting mechanism.

Figure 1:
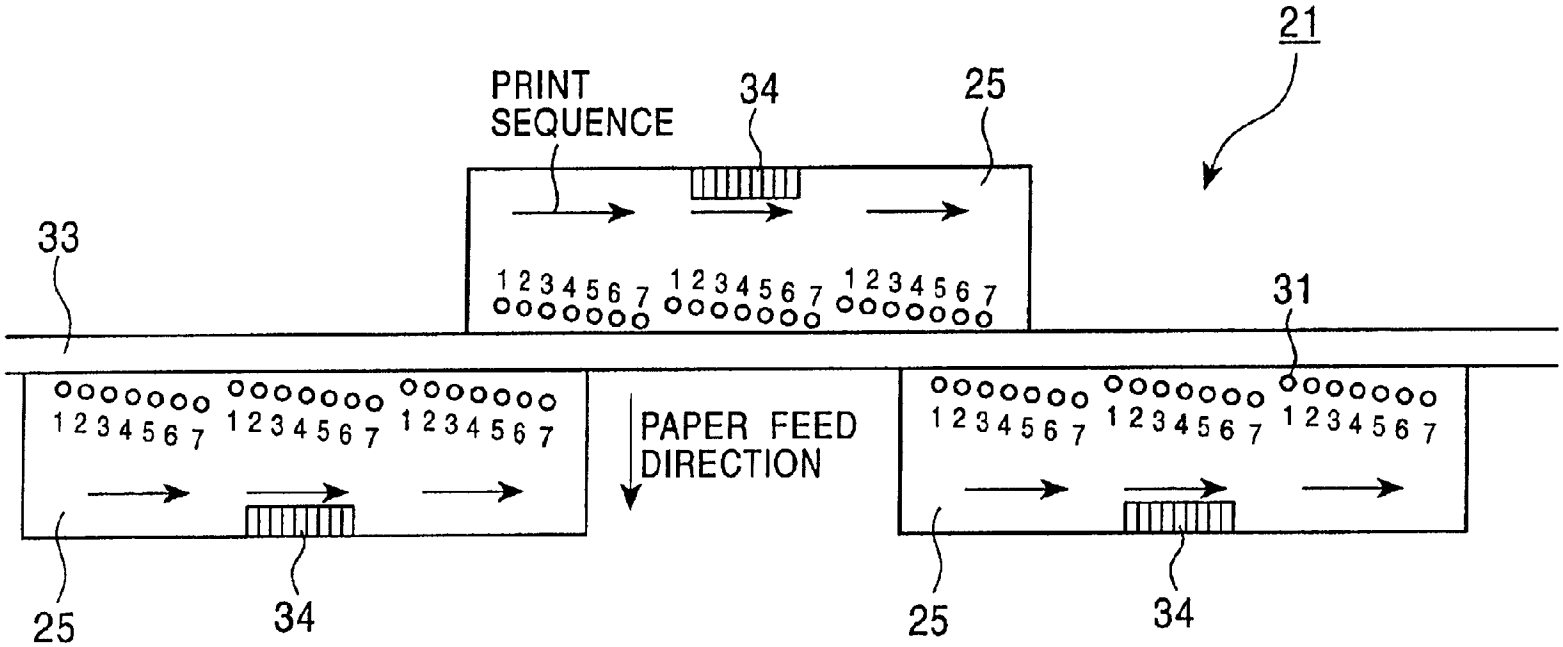
FIG. 1 is a plan view of placement for head chips in accordance with the second embodiment of the present invention.

In FIG. 1, a part of the head chips 25 is zoomed in from the paper 14 side. The head chips 25 are placed on both sides of the ink-flow path 33 alternately in the same configuration. Also, each head chip 25 is placed on each side of the ink-flow path 33 such that they are rotated in 180 degrees so as to guide ink from each side of the ink-flow path 33. By this mechanism, the head 21 can be supplied with ink from only one ink-flow path 33 for each color, thereby making it possible to print with high resolution by easy configuration.

Also, when the head chips 25 are placed in a direction rotated by 180 degrees alternately, the pad 34 is placed almost at the middle in the direction of placing nozzles 31 such that the direction of the pad 34 will not be changed for placing nozzles 31. Thus, in the head 21, concentration is prevented on a part of flexible wiring substrate connecting to the pad 34.

In the head 21, a predetermined number of successive nozzles 31 are grouped together to form a unit, and in the group, the orifice plate 23 is created such that each nozzle is shifted from the other in a direction of the paper feed. In corresponding to the orifice plate 23, the heaters 28 of the head chips 25 are created at the positions shifted from the others in a direction of the paper feed, a predetermined number of which form a unit. Moreover, in FIG. 1, the amount of the shift in a direction of the paper feed is exaggerated. Also in FIG. 1, to simplify the explanation, the nozzles are grouped into three groups each of which include seven nozzles as a unit.

In the head chips 25 as described above, the shifted position of the nozzles 31 is used effectively to drive the grouped heaters 28 sequentially. Moreover, when nozzles 31 are shifted In such a manner, for the head chips 25 placed on both the upper side and lower side of the ink-flow path 33, heaters 28 are driven in the inverse direction for the driving signal. In this embodiment, for each head chip 25, the driving circuit is configured such that the driving sequence can be switched in accordance with the above-mentioned driving sequence.

Figure 5:
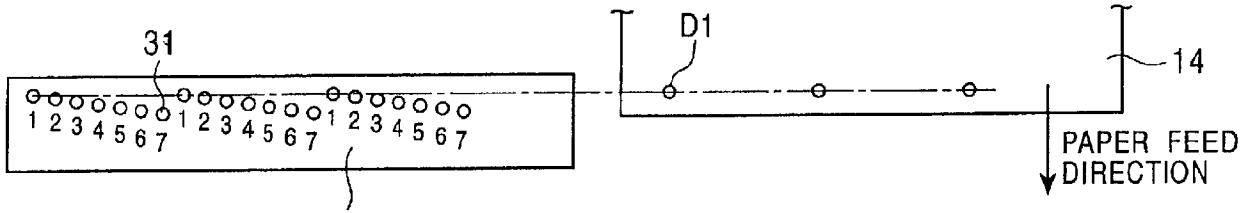
FIG. 5 is a schematic diagram illustrating driving of the head chips in FIG. 4.
Figure 6:
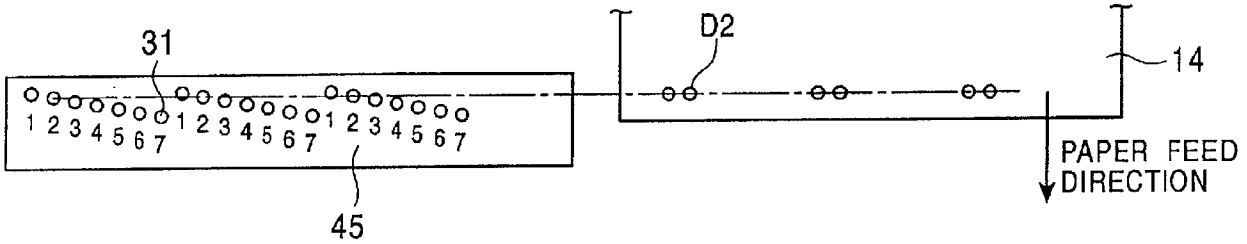
FIG. 6 is a schematic diagram illustrating driving of the head chips in FIG. 4.
Figure 7:
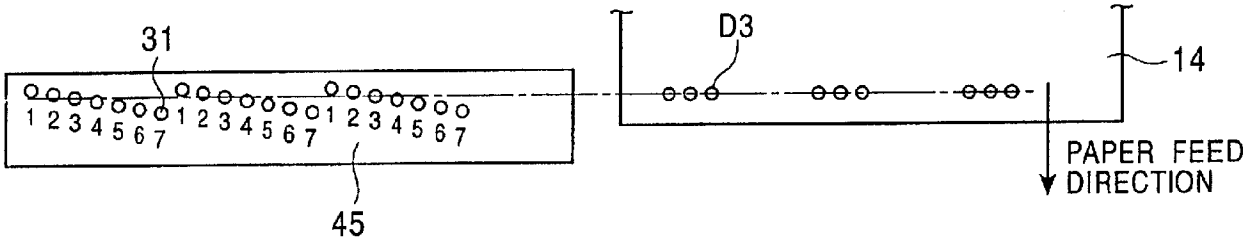
FIG. 7 is a schematic diagram illustrating driving of the head chips in FIG. 4.
Figure 8:
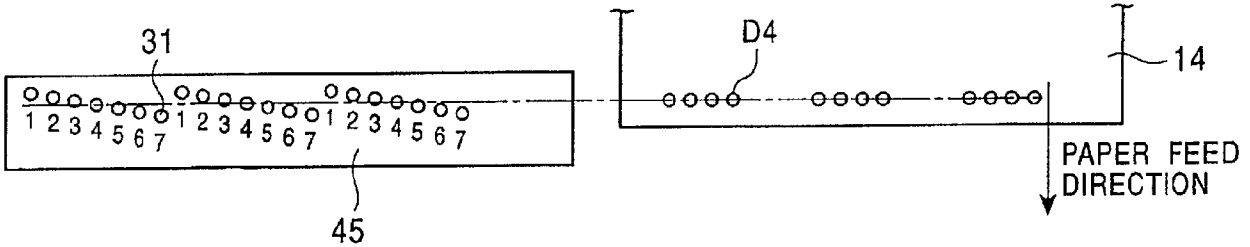
FIG. 8 is a schematic diagram illustrating driving of the head chips in FIG. 4.
Figure 9:
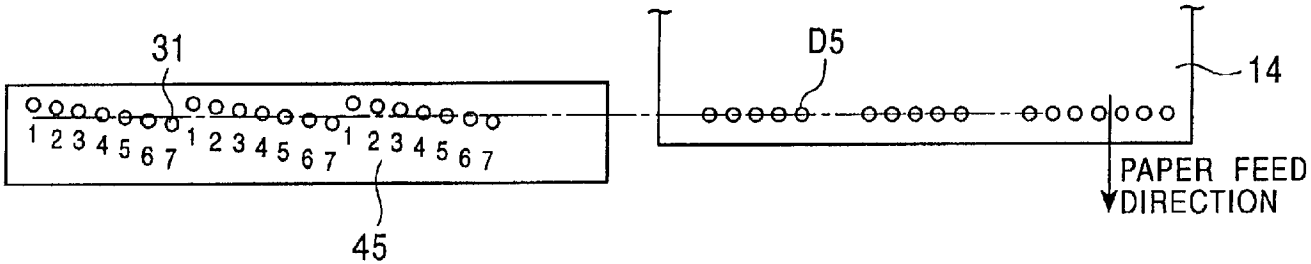
FIG. 9 is a schematic diagram illustrating driving of the head chips in FIG. 4.
Figure 10:
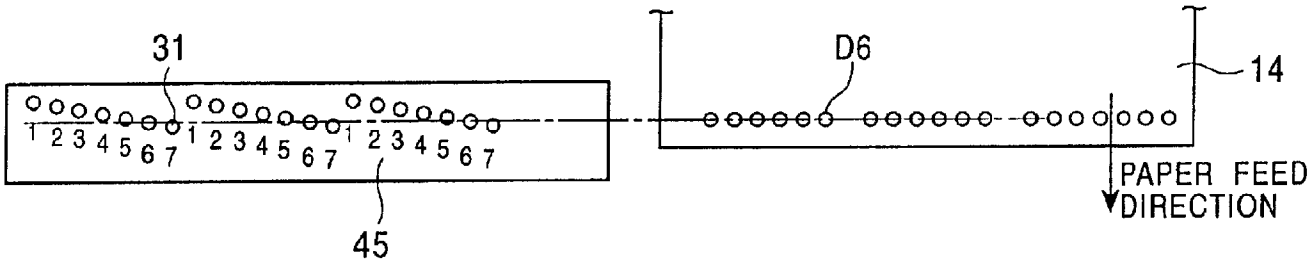
FIG. 10 is a schematic diagram illustrating driving of the head chips in FIG. 4.
Figure 11:
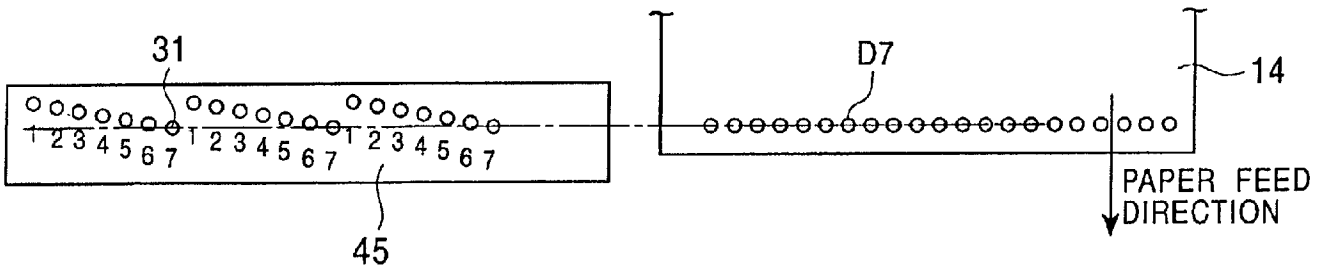
FIG. 11 is a schematic diagram illustrating driving of the head chips in FIG. 4.

As shown in FIGS. 5 to 11, in this embodiment, seven nozzles 31 forming each group are controlled sequentially in respective phases, from the phase 1 through phase 7, starting from the nozzle 31 at the feeding side of the paper 14. In FIGS. 5 to 11, the number corresponding to each phase is given to the relevant nozzle. As shown in FIG. 5, when the paper 14 is fed, in the start phase 1, the nozzle 1, which is the nearest to the paper feeding side, is driven to print the dot Dl. Then the paper 14 is fed as much as for printing by the subsequent nozzle 2 (FIG. 6), the subsequent nozzle 2 is driven to print the dot D2. Thus, by driving the nozzles 3 to 7 in synchronization with feeding the paper, the dots are printed sequentially (in FIGS. 7 to 11). As a result, in this embodiment, the nozzles 31 in a group are driven such that they are driven with some time difference. Also, the corresponding nozzles 31 of each group are to be driven concurrently.

Moreover, the head 21 can print a dot by a plurality of droplets. By making variable the number of the droplets for a dot, the size of the dot can be variable so as to express gradation. In this embodiment, the dot can be created by eight droplets at maximum.

In the head 21, driven in this way (FIG. 1), some of the nozzles allocated to one head chip are placed so as to be partly overlapped with a plurality of nozzles allocated to adjacent head chips as viewed from the direction of feeding a print object in order for the ink droplets to be adhered to almost the same point. By this, in the line printer 11, for the overlapped area of printing dots by adjacent head chips by these nozzles, the dots printed by these adjacent head chips are mixed, so that irregular characteristics of adjacent chips are unnoticeable by mixture of these dots, thereby making it possible to prevent quality deterioration of print result.

Figure 12:
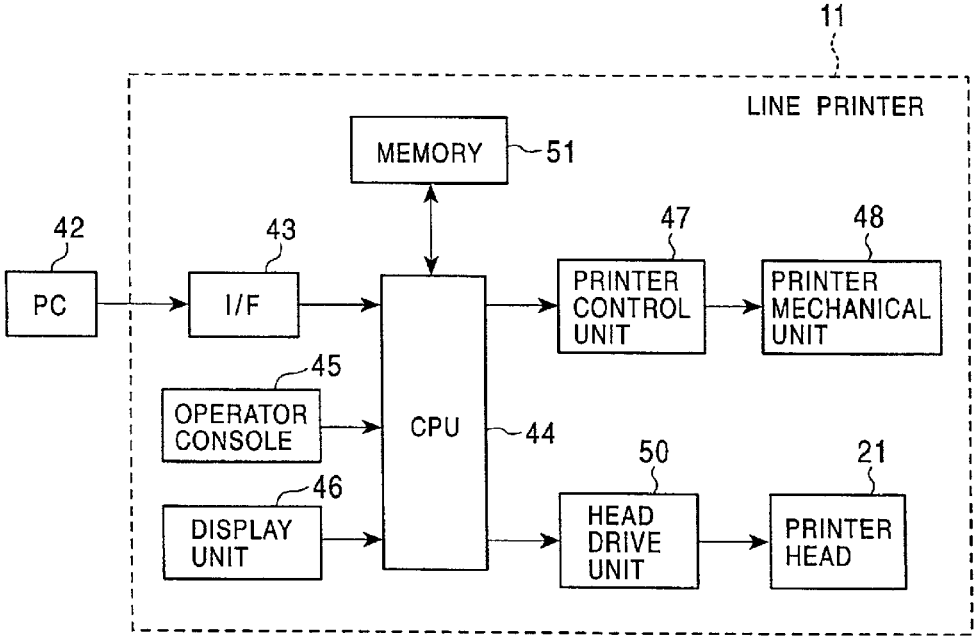
FIG. 12 is a block diagram of the line printer in FIG. 2.

FIG. 12 is a block diagram of the line printer, In the printer 11, the interface (I/F) 43 receives control commands, text data and image data from the host system, personal computer 42, and sends them to the Central Processing Unit (CPU) 44. The console 45 is a pressing-button console attached to the line printer 11. In the printer 11, by operating the console 45, instructions can be accepted for example, setting various printing positions, testing print and so on. The display unit 46 comprises the liquid-crystal panel attached to the console panel, and, in response to the operations of the console 45, it can be used to display menus for various settings and the detailed information.

The printer mechanical unit 48 comprises the paper-feeding mechanism of the printer 11 as described above in FIG. 2. The printer control unit 47 controls the printer mechanical unit 48 under the control of the central processing unit 44. The head drive unit 50 comprises the drive circuit for driving each head chip of the line head 21 under the control of the central processing unit 44. By these units, the printer 11 drives the line head 21 while feeding the paper 14 to enable printing an image in color under the control of the central processing unit 44 in accordance with the output data from the personal computer 42.

The central processing unit 44 comprises the controller together with the memory 51 to control actions of the printer 11. The unit analyses the control commands which are input via the interface 43, and processes text data and image data based on the analysis result to control the printer controller 47 and the head drive unit 50. Thus, these text data and image data are printed.

In the line printer 11 having the above configuration, by the processing of the head drive unit 50, the head 21 is driven such that dots printed by two adjacent head chips are mixed in the area where the above-mentioned dot-print spots are overlapped with adjacent head chips.

Figure 13:
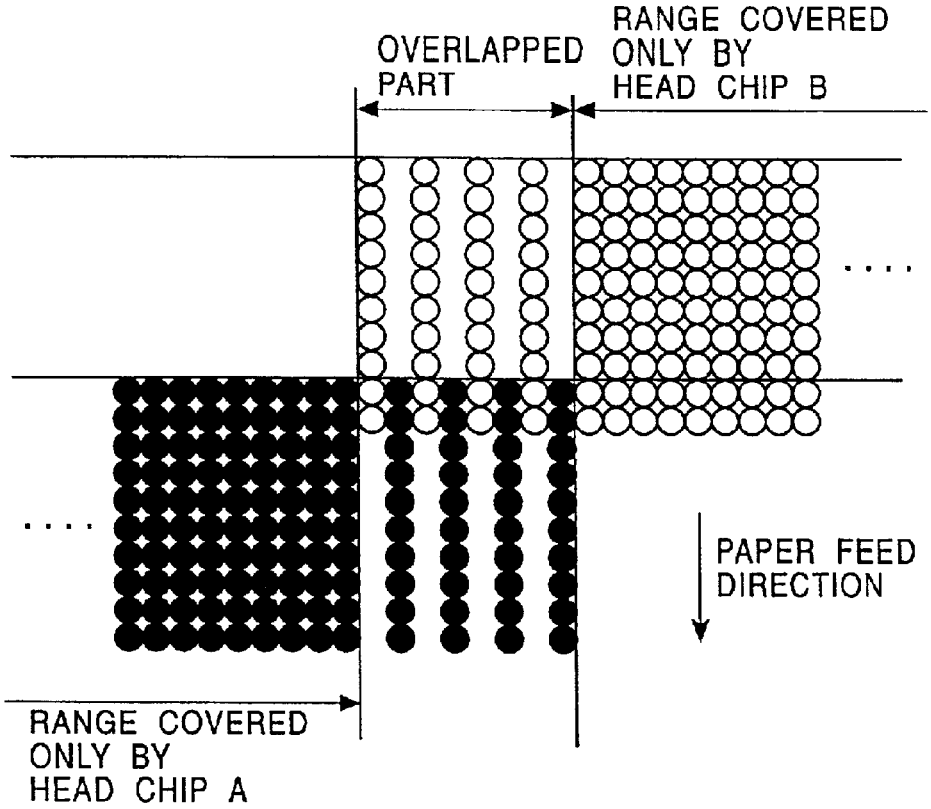
FIG. 13 schematically illustrates driving of the head chips in FIG. 1.

FIG. 13 schematically illustrates driving of the adjacent head chips by the head drive unit 50. Moreover, FIG. 13 is an example when eight nozzles are overlapped in adjacent head chips. In this figure, the dots which are to be printed by each of adjacent head chips are shown by black circles and white circles, respectively. As for this overlapped area, the head drive unit 50 supplies selectively, according to the predetermined settings, each of adjacent head chips either with the driving data supplied via the central processing unit 44 or with the dummy data for printing no dots in order to print dots which are mixed by the two head chips in the overlapped area.

In the head drive unit 50, in this overlapped area, in the nozzle array direction, these two head chips 25 handle printing dots alternatively. Also, in the direction of feeding paper, such an alternative coverage is repeated, and the driving data and dummy driving data are output selectively from the central processing unit 44. As a result, in the line printer 11, for example, when printing a large area in a single color, the head 21 is driven such that in the overlapped part, the print result is intermediate gradation between the print results of the adjacent head chips. Therefore, even if the characteristics of adjacent head chips are different, sharp difference of the print result due to the different characteristics can be avoided in the overlapped area, which can prevent quality deterioration of the print result.

(1-2) The Actions of a First Embodiment

In the above configuration of the line printer 11 (FIG. 2), the paper 14 held in the paper tray 13 is fed by the pinch roller 16, and then the feeding direction is switched by the reversal roller 17, and the paper is guided in the direction to the outlet at the front side. In the line printer 11, when the paper is guided towards the outlet at the front side, from the ink cartridges held in the head cartridge 20, yellow, magenta, cyan and black ink, that is Y, M, C, B, respectively are supplied to the line head of the head 21. Thus, the ink droplets are adhered onto the paper 14 to print a desired image.

Specifically, in each line head of the head 21 (FIG. 4), from these ink cartridges Y, M, C, and B, the respective ink is guided through the ink-flow path 33 into each ink bed 30, and then heated by the heaters 28 to be ejected as a bubble from the nozzles 31, and is adhered onto the paper 14. Thus, the line printer 11 makes it possible to print a desired image by driving the heaters 28 selectively using a desired drive circuit while feeding the paper.

In the head 21, on the semiconductor substrate 27, the heaters 28 are placed sequentially, and also on the semiconductor substrate 27, the drive circuits 29 for the heaters 28 are placed to form the head chip 25. The array of the head chips 25 forms the head 21 (FIG. 3).

Furthermore, the head chip 25 comprises a predetermined number of nozzles as a unit, and the nozzle position in each group is formed such that the positions are shifted sequentially in the paper feed direction (FIG. 1 and FIGS. 5 to 11). Thus, in the line printer 11, driving timing of each nozzle in a group is shifted so as to keep spare time, and the corresponding nozzles among the group are driven concurrently so as to shorten the time required for printing.

In this embodiment, since the line printer 11 comprises the head chips 25 placed like the above to form the head 21, some of the nozzles allocated to one head chip are placed so as to be partly overlapped with a plurality of nozzles allocated to adjacent head chips at the adjacent chips as viewed from the direction of feeding a print object in order to ink droplets to be adhered to almost the same point. By this, in the line printer 11, for the overlapped area of printing dots by adjacent head chips by these nozzles, the dots printed by these adjacent head chips are mixed, so that irregular characteristics of adjacent chips are unnoticeable by mixing these dots, thereby making it possible to prevent quality deterioration of print result.

In the line printer 11 (FIG. 12), text data and image data, which are output from the personal computer 42, are input through the interface 43, and based on this input data, the central processing unit 44 controls the printer control unit 47 and the head drive unit 50 to drive the head 21 while feeding the paper in the predetermined direction, thus, the input data of characters and image are printed on the paper 14.

In the line printer 11, as for the overlapped area of head chips, the driving data which is output from the central processing unit 44 and dummy data for printing no dots are supplied selectively by the head drive unit 50, thus, dots are printed such that they are mixed by two head chips (FIG. 13).

In this overlapped area, in the nozzle array direction, these two head chips 25 handle printing dots alternatively. Also, in the direction of feeding the paper, such an alternative coverage is repeated. In this way, the head 21 is driven by the driving data and dummy driving data which are output selectively from the central processing unit 44. As a result, the head is driven such that, in the overlapped part, the print result is intermediate gradation between the print results of the adjacent head chips. Therefore, even if the characteristics of adjacent head chips are different, sharp difference of the print result due to the different characteristics can be avoided in the overlapped area, which can prevent quality deterioration of the print result.

When preventing quality deterioration of the print result by partly mixing dots produced from the two head chips, if the two head chips are not positioned correctly, a dot print spot by one of the head chip may be misplaced against a dot print spot by the other head chip, thereby deteriorating quality of the print result.

However, in this embodiment, the nozzles 31 for a plurality of head chips are made on one piece of the nozzle plate 23, on which a plurality of head chips 25 are placed such that the ink beds 30 and the heater elements 28 are built in (FIGS. 3 and 4). Thus, even if the head chips 25 are misplaced, it is possible to prevent misplacement of the nozzles 31 that cause the positioning errors of dots. Specifically, in the processing of making the nozzle 31 on the nozzle plate 23 made of one thin plate, photolithography technology can be applied, thereby making it possible to make the nozzles with a very high precision of 1 $\mu$m or less. Thus, it is possible to effectively prevent deterioration of print quality due to misplacement of the head chips 25.

Figure 14:
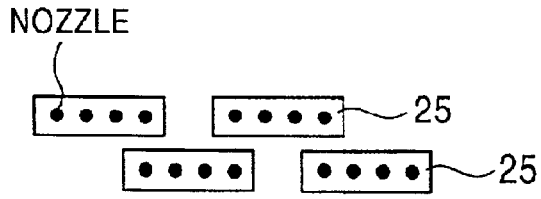
FIG. 14 is a plan view illustrating misplacement of the head chips.
Figure 15:
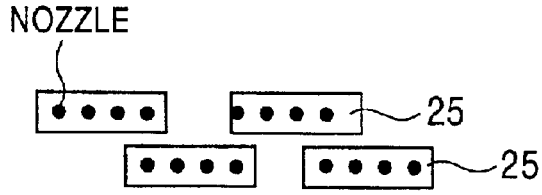
FIG. 15 is a plan view illustrating misplacement of the head chips.
Figure 16:
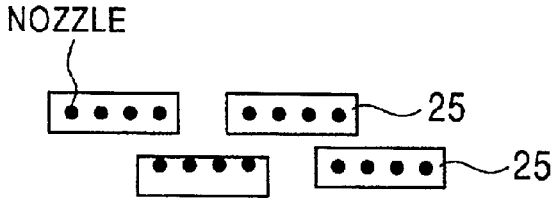
FIG. 16 is a plan view illustrating misplacement of the head chips.
Figure 17:
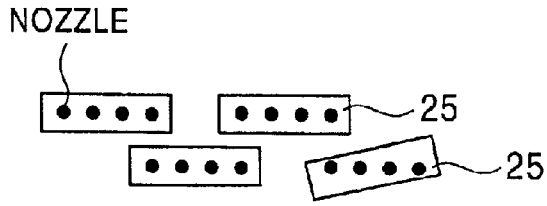
FIG. 17 is a plan view illustrating misplacement of the head chips.

More specifically, there is a case, as shown in FIG. 15 where the head chips are misplaced in the perpendicular direction of alignment of heads when comparing with the case of placing the head chips 25 correctly as shown in FIG. 14. Also, as shown in FIG. 16, there is a case that the misplacement is in the direction of paper feed, and that alignment in inclining as shown in FIG. 17. Even in these misplaced cases, since the nozzle 31 is correctly positioned, the misplaced head chips 25 can make a dot at the right position determined by the positions of the nozzles. Therefore, it is possible to prevent deterioration of print quality due to misplacement of dots in the same color.

Additionally, with this arrangement of a printer head, misplacement of dot print point in different colors can also be prevented, thereby making it possible to prevent deterioration of print quality due to misplacement of head chips of different colors.

Figure 18:
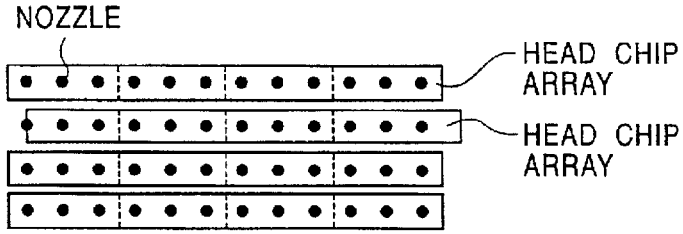
FIG. 18 is a plan view illustrating deterioration of print quality by misplacement of dots in different colors.
Figure 19:
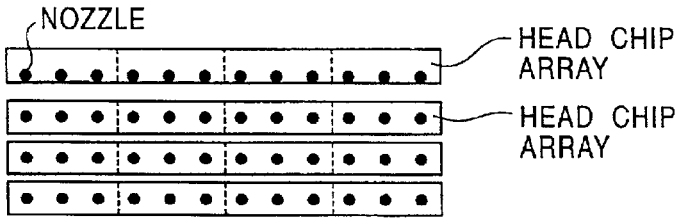
FIG. 19 is a plan view illustrating deterioration of print quality by misplacement of dots in different colors.
Figure 20:
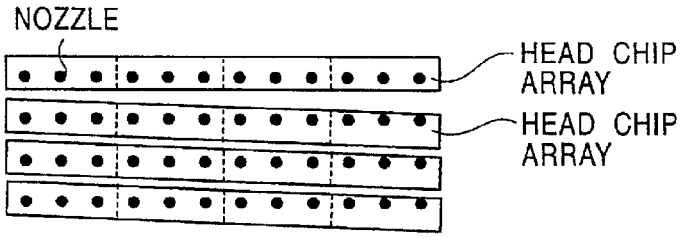
FIG. 20 is a plan view illustrating deterioration of print quality by misplacement of dots in different colors.
Figure 34:
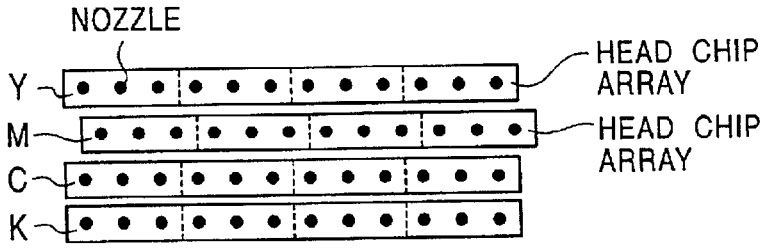
FIG. 34 schematically illustrates deterioration of the print result due to misplacement of a head chip array.
Figure 35:
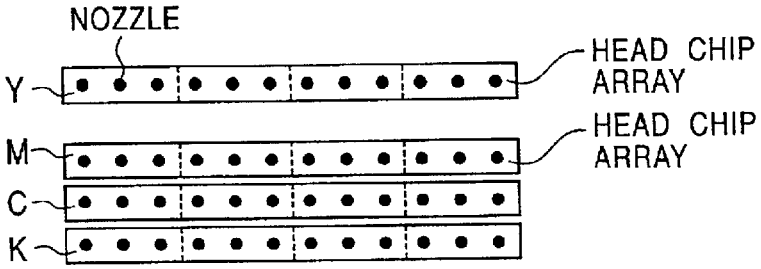
FIG. 35 schematically illustrates deterioration of the print result due to misplacement of a head chip array.
Figure 36:
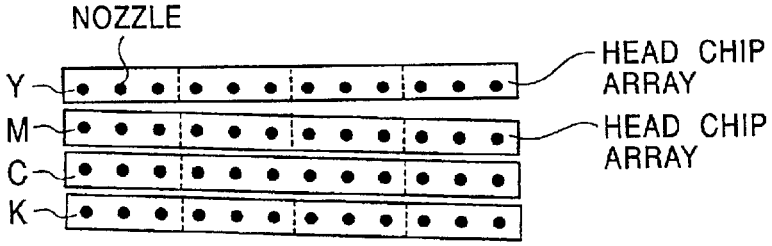
FIG. 36 schematically illustrates deterioration of the print result due to misplacement of a head chip array.

Specifically, misplacement among the arrays of the head chips 25 is shown in FIGS. 18 to 20 compared with FIGS. 34 to 36. There is a case where misplacement is in the perpendicular direction of the printing (FIG. 18), a case where misplacement is in the direction of paper feed (FIG. 19), and a case that a particular array of head chips is placed inclining (FIG. 20). In these cases, as mentioned above, a head-chip array of a conventional fabrication cannot prevent dot misplacement for each color, deteriorating the print quality.

On the other hand, in this embodiment, since nozzles are made on one nozzle sheet with high precision, thus the nozzle array corresponding to each head chip array is also made with high positioning precision mutually. Thus, even if misplacement occurs among the head chip arrays, it is possible to prevent dot misplacement among different colors.

In this connection, if one long head chip having a print width is used instead of a head chip array, it is not possible to fully prevent such misplacement among the arrays. Even in this case, nozzles are made on the nozzle plate, on which head chips are placed to form a printer head, thereby making it possible to prevent misplacement of dot positions among different colors. In FIGS. 18 to 20, head chip arrays shown in FIG. 3 are simplified.

The following is some additional description on the above-mentioned case where a head chip having a print width is used to form a printer head. The above-mentioned head chip is created by cutting a disc-shaped silicon substrate. When creating the longer head chip having a print width, the fewer the number of head chips can be taken from the silicon substrate lowers the yield rate. Furthermore, when creating the longer head having a print width, it is necessary to incorporate the larger number of elements such as heaters and so on into one head chip, thereby lowering the total yield rate. Besides, wiring pattern to be formed on the head chip will be longer, thereby giving more influence on the head chip by the resistance value of the wiring pattern. Therefore, for a head chip, the above-mentioned head chip 25 is preferable to a long head chip having a print width.

(1-3) The Effects of the First Embodiment

In the above configuration, some of the nozzles allocated to one head chip are placed so as to be partly overlapped with a plurality of nozzles of adjacent head chips as viewed from the direction of feeding a print object in order for ink droplets to be adhered to almost the same point, thereby making it possible to prevent quality deterioration of print result caused by irregular characteristics of adjacent chips.

Also, in the partly overlapped area, by driving the head chips such that a spot of printing dots covered by a head chip and a spot of printing dots covered by the other head chip are mixed, it is possible to make unnoticeable the sharp difference of the print result caused the head chips of irregular characteristics, which can prevent quality deterioration of the print result.

Also, by repeating the drive of these two head chips in the perpendicular direction to the paper feed direction, spots of printing dots are mixed by the two head chips so as to prevent quality deterioration of the print result with a simple configuration.

Furthermore, a nozzle array including a plurality of nozzles is formed on one nozzle plate, on which a plurality of head chips are placed corresponding to a nozzle array to form a printer head, thereby making it possible to prevent quality deterioration of the print result due to positioning errors of head chips.

Specifically, nozzles are placed on one nozzle plate almost as wide as a print object on one plate to form a nozzle array in a direction perpendicular to the feeding direction of a print object, thereby preventing dot positioning error in the same color, and making it possible to prevent quality deterioration.

Moreover, nozzles are placed on one nozzle plate almost as wide as a print object on one plate to form a nozzle array in a direction perpendicular to the feeding direction of a print object and a plurality of arrays are formed in the direction of feeding a print object, thereby making it possible to prevent quality deterioration of the print result among different colors.

Additionally, head chips are placed so as to partly overlap adjacent head chips, thereby making it possible to prevent quality deterioration due to irregularities of head chips.

(2) A Second Embodiment

Figure 21:
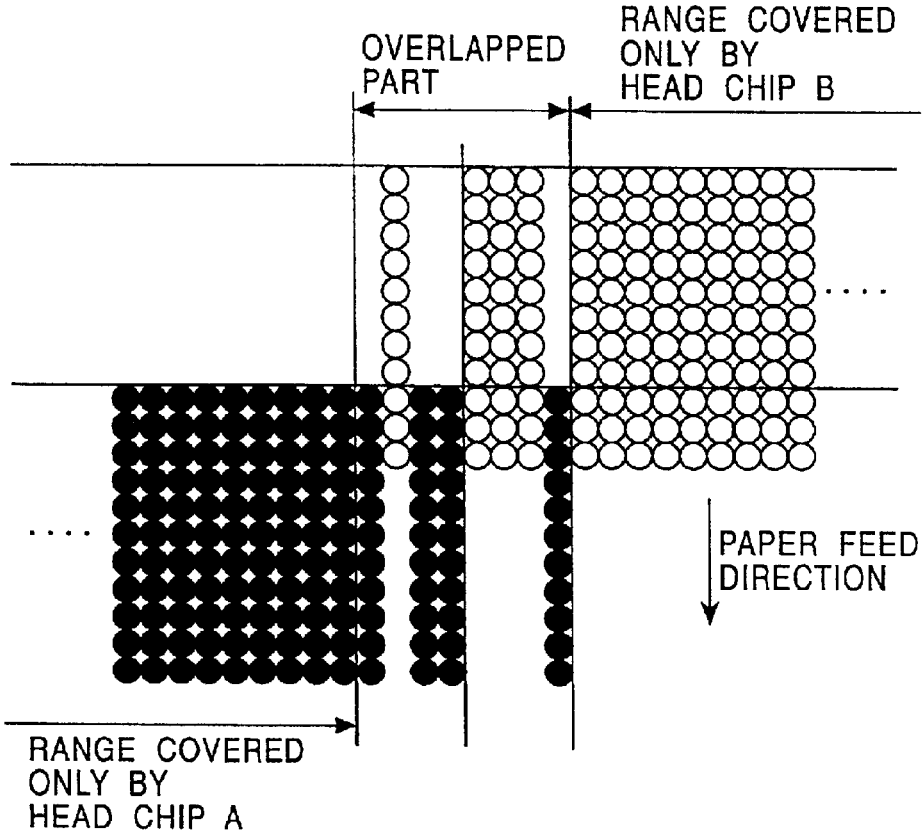
FIG. 21 schematically illustrates driving of the head chips of a printer in accordance with the second embodiment of the present invention in comparison with FIG. 13.

FIG. 21 schematically illustrates, in comparison with FIG. 13, driving of adjacent head chips by the head drive unit 50 of a printer in accordance with the second embodiment of the present invention. In a line printer in accordance with the second embodiment, except that the processing of the head drive unit 50 is different, the configuration is the same as the line printer 11 in accordance with the first embodiment.

The head drive unit 50 sets the driving of each head chips such that, in the overlapped area, when it is nearer to each one of head chips from the center of the overlapped area (shown by one-dot chain line), the number of dots covered by the chip will become bigger. Thus, in FIG. 21, the setting is made such that on the left side of the overlapped area, the left-side chip covers three dots out of four, whereas on the right-side, one dot is covered.

As a result, in this embodiment, in the overlapped area, the gradation is applied such that it is smoothly changed from the print result of the left-side head chip to the right-side head chip on the whole. This results in a better printout, thereby making it possible to prevent quality deterioration of print result.

In the configuration of FIG. 21, by setting in such a manner that, in the overlapped area, when it is nearer to either one of head chips, the number of dots covered by the chip will become bigger. And a spot of printing dots by one head chip and a spot of print dots by the other head chip are mixed. This can better prevent quality deterioration of print result.

(3) A Third Embodiment

Figure 22:
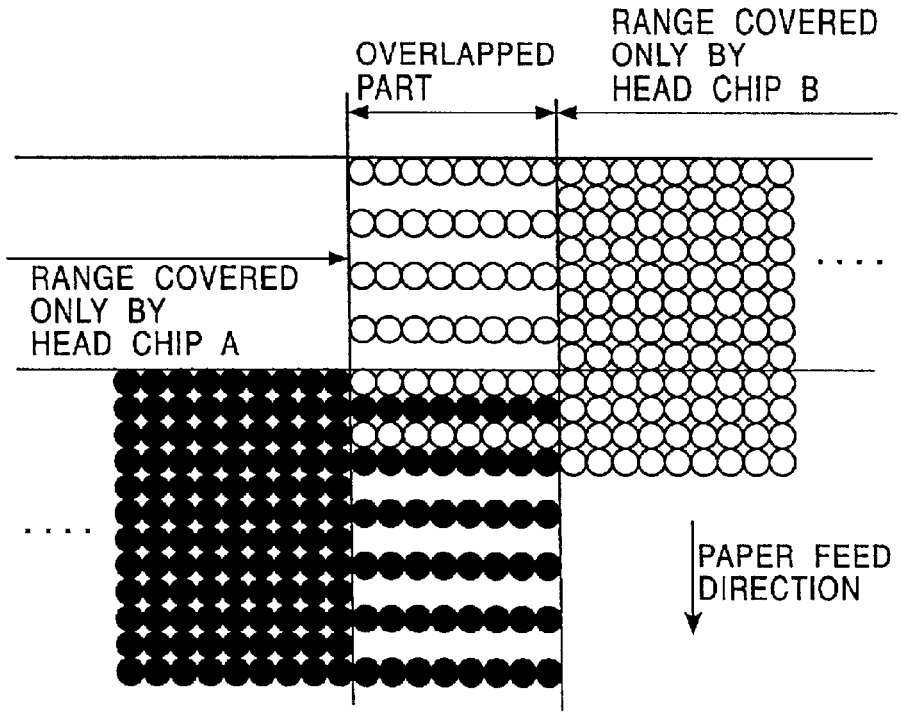
FIG. 22 schematically illustrates driving of the head chips of a printer in accordance with the third embodiment of the present invention in comparison with FIG. 13.

FIG. 22 schematically illustrates, in comparison with FIG. 13, driving of adjacent head chips by the head drive unit 50 of a printer in accordance with the third embodiment of the present invention. In a line printer in accordance with the third embodiment, except that the processing of the head drive unit 50 is different, the configuration is the same as the line printer 11 in accordance with the first embodiment.

The head drive unit 50 sets the driving of each head chips such that, in the overlapped area, the head chips are switched to perform printing dots per each line. Thus, instead of the above-mentioned vertical dot array in accordance with the first embodiment, using lateral dot array, in the overlapped area, spots of printing dots are mixed respectively by the two head chips.

In the configuration of FIG. 22, the head chips can be switched to cover printing dots per each line, and in the overlapped area, spots of printing dots can be mixed respectively by the two head chips. This also results in the same effect as in the case of the first embodiment.

(4) The Fourth Embodiment

Figure 23:
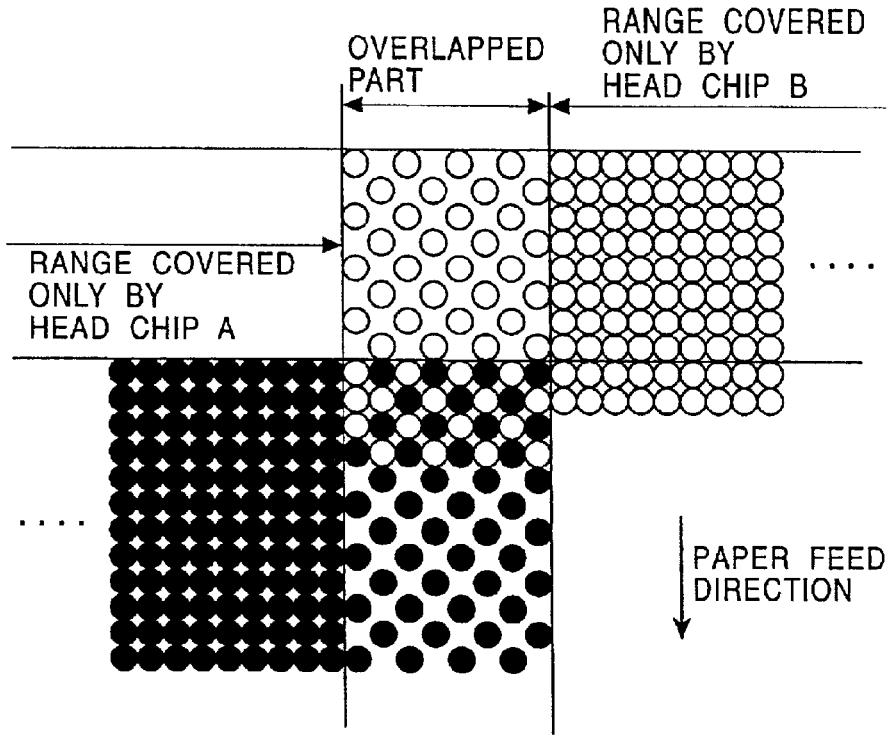
FIG. 23 schematically illustrates driving of the head chips of a printer in accordance with the fourth embodiment of the present invention in comparison with FIG. 13.

FIG. 23 schematically illustrates, in comparison with FIG. 13, driving of adjacent head chips by the head drive unit 50 of a printer in accordance with the fourth embodiment of the present invention. In a line printer in accordance with the fourth embodiment, except that the processing of the head drive unit 50 is different, the configuration is the same as the line printer 11 in accordance with the first embodiment.

The head drive unit 50 sets the driving of two head chips such that, spots of printing dots are allocated in accordance with the combination of the first and the third embodiments. This means that printing dots is allocated such that as in the paper feed direction, the head chips are switched to cover printing dots per each line. Moreover, in a direction perpendicular to the paper feed direction, printing dot is allocated such that the head chips are switched alternatively. Thus, the line printer 11 can produce the average print result of the characteristic of each head chip, in the overlapped area, even in the case of printing a vertical direction pattern or lateral direction pattern, in which only certain nozzles are driven in either in the paper feed direction or in a direction perpendicular to the paper feed direction.

In the configuration of FIG. 23, the setting is made such that, the head chips are switched alternatively to be allocated for printing dots in the paper feed direction and in perpendicular direction to the paper feed direction. This enables various kinds of print objects to be printed with an average characteristic of each head in the overlapped area. Thus, in comparison with the first and the third embodiments, it is possible to even more effectively prevent quality deterioration of print result.

(5) A Fifth Embodiment

Figure 24:
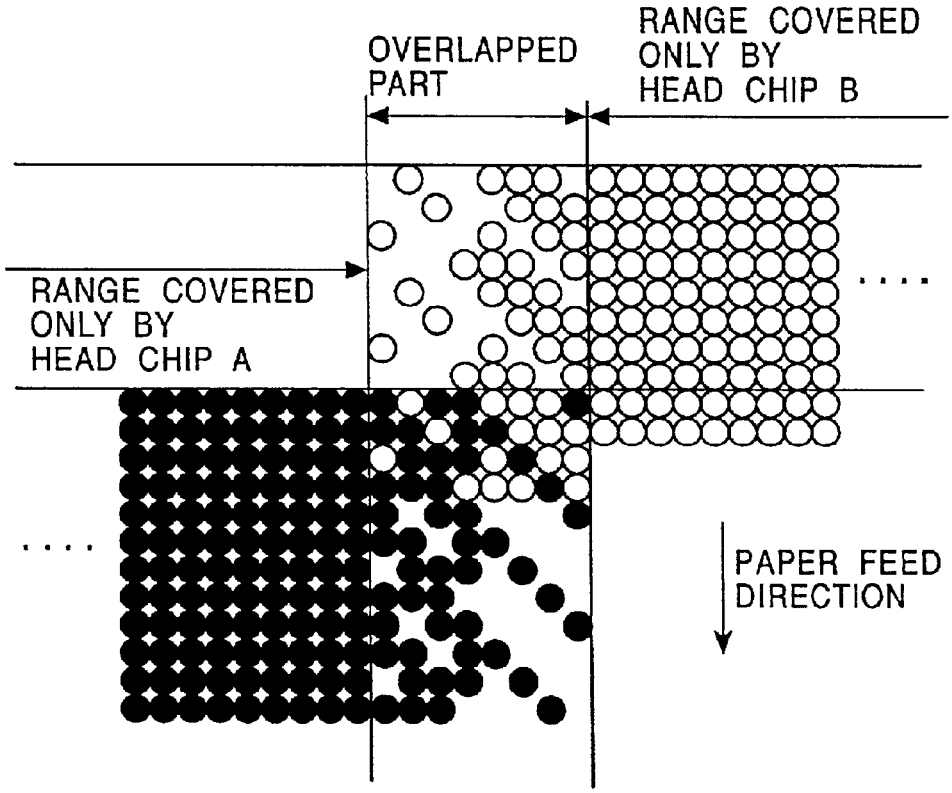
FIG. 24 schematically illustrates driving of the head chips of a printer in accordance with the fifth embodiment of the present invention in comparison with FIG. 13.

FIG. 24 schematically illustrates, in comparison with FIG. 13, driving of adjacent head chips by the head drive unit 50 of a printer in accordance with the fifth embodiment of the present invention. In a line printer in accordance with the fifth embodiment, except that the processing of the head drive unit 50 is different, the configuration is the same as the line printer 11 in accordance with the first embodiment.

The head drive unit 50 sets the driving of the two head chips such that, spots of printing dots are allocated in accordance with the combination of the second and the third embodiments. This means that dot printing is allocated such that as in the paper feed direction, the head chips are switched to cover printing dots per each line. Moreover, in a direction perpendicular to the paper feed direction, when it is nearer to either one of head chips, printing dots is allocated such that the number of dots covered by the chip will be become bigger. Thus, the line printer 11 can produce the average print result of the characteristic of each head chip, in the overlapped area, even in the case of printing a vertical direction pattern or lateral direction pattern, in which only certain nozzles are driven either in the paper feed direction or in the perpendicular direction to the paper feed direction. Also, the print result is such that it is smoothly changed from the print result of the left-side head chip to the right-side head chip on the whole.

In the configuration of FIG. 24, the setting is made such that it is possible to prevent even more effectively quality deterioration of print result.

(6) A Sixth Embodiment

In this embodiment, the layouts described in FIGS. 13, 22 and 23 are supplemented by the dot diameters which were measured beforehand. This means that in this embodiment, for example, at the time of checking the nozzles in the manufacturing process, the diameter of a dot created by each nozzle per one drive is measured, and the average of the dot diameter is computed per each head chip.

Moreover, instead of an alternative head switching as described in FIGS. 13, 22 and 23, switching head chips is supplemented such that the above-measured difference of the dot diameter is supplemented. This means that, in the overlapped area, switching the head chips is performed such that printing is performed using the average gradation compared with the case that each one of the head chip is used for printing based on the same condition.

Figure 25:
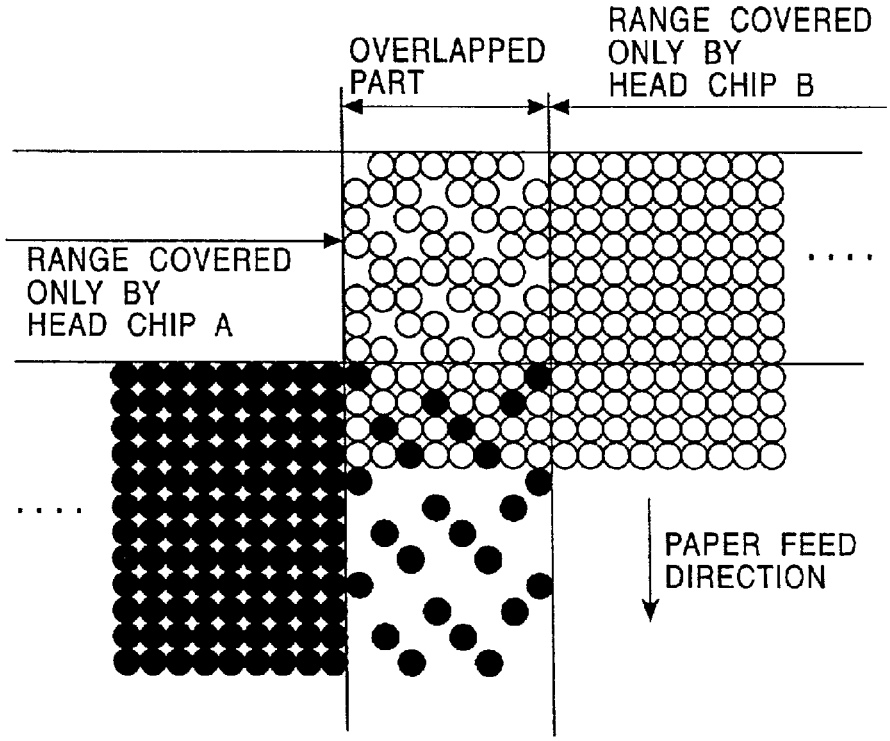
FIG. 25 schematically illustrates driving of the head chips of a printer in accordance with the sixth embodiment of the present invention in comparison with FIG. 13.

Taking the layout shown in FIG. 23 for example, this layout is supplemented as shown in FIG. 25. In this case, the number of dot-print spots covered by the left side nozzle is set as one fourth in the total overlapped area.

In a sixth embodiment, if the characteristics of the head chips are particularly irregular when dot-print spots are mixed according to the pre-measured print result, it is possible to prevent quality deterioration of print result even more effectively than the above-mentioned embodiments.

(7) A Seventh Embodiment

Figure 26:
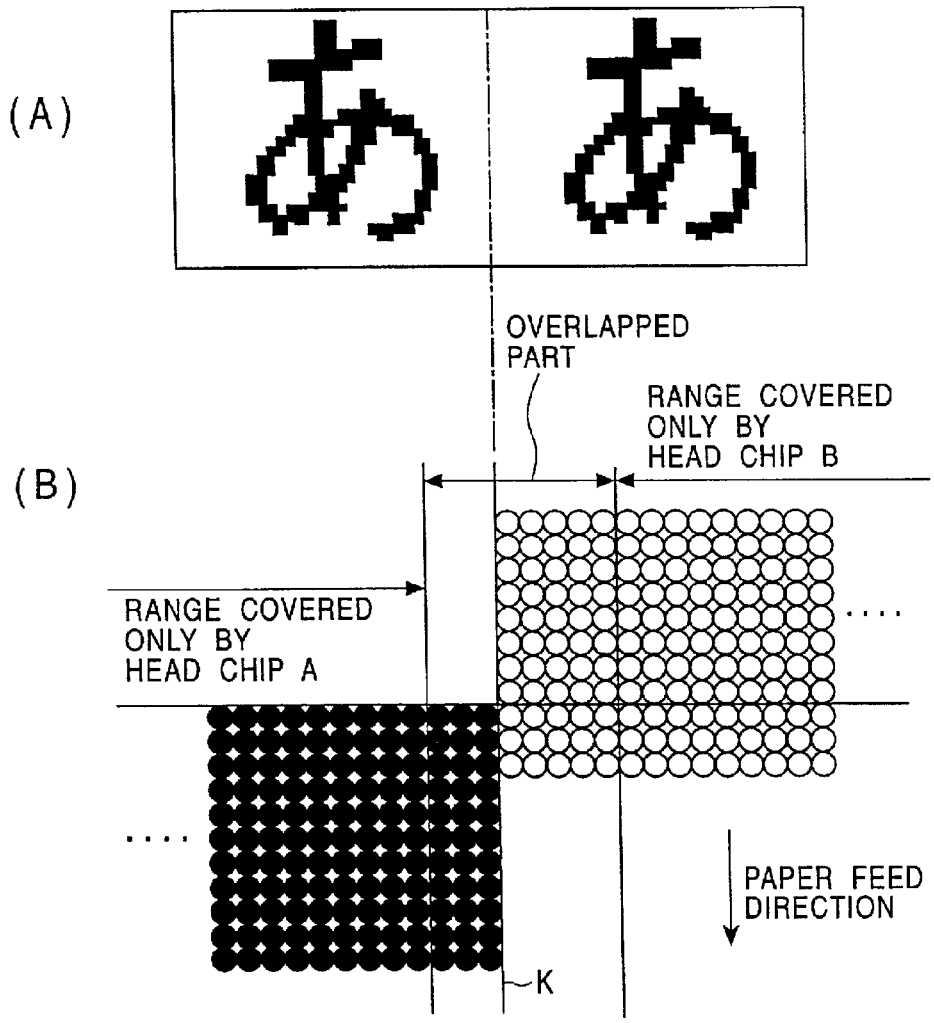
FIG. 26 schematically illustrates driving of the head chips of a printer in accordance with the seventh embodiment of the present invention.

In this embodiment, as shown in FIG. 26, the boundary K is set in the overlapped area, and using the boundary K, spots of printing dots are allocated to the head chips covering both sides of the boundary in the overlapped area, and the boundary K is shifted appropriately. In a line printer in accordance with the seventh embodiment, except for a difference in the processing of the central processing unit 44 and the head drive unit 50 on the setting of the boundary, the configuration is the same as a line printer 11 in accordance with the first embodiment, so that the explanation is given using the configuration in FIG. 12.

Figure 27:
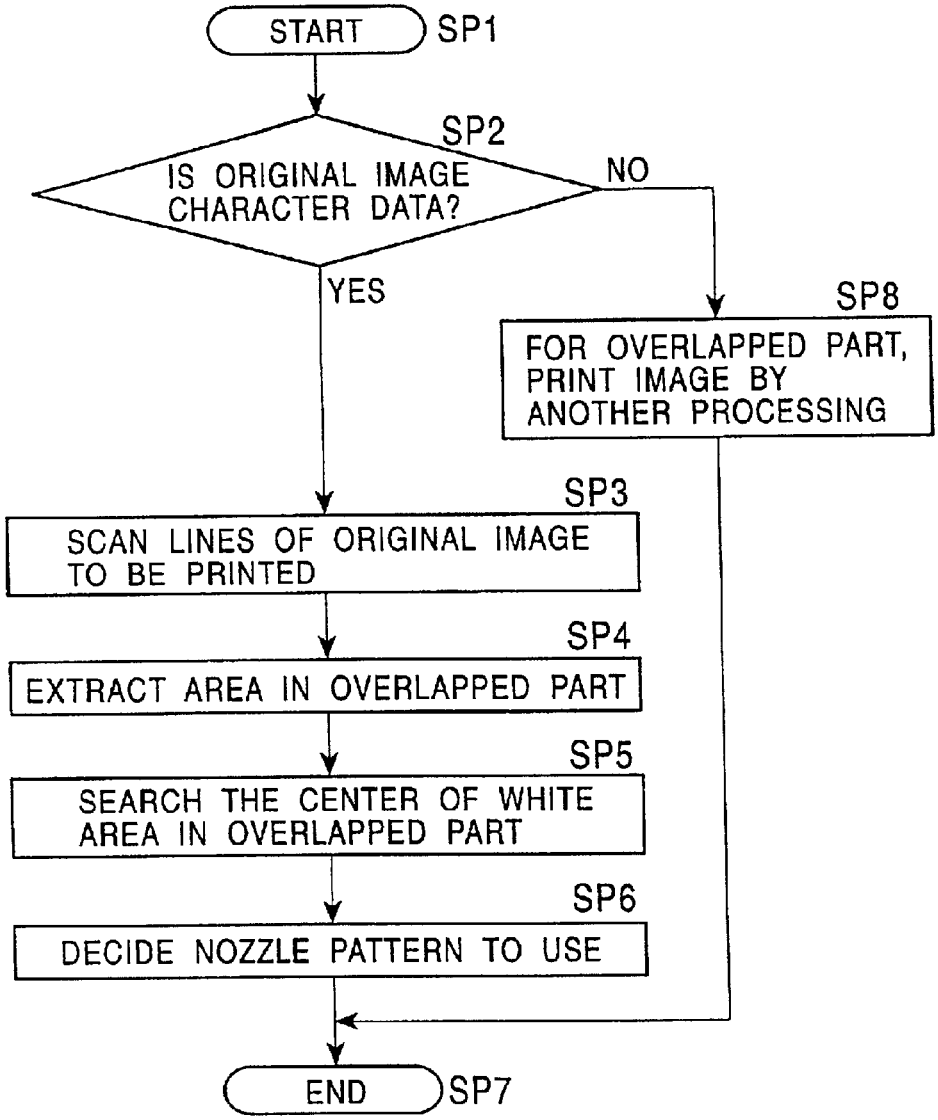
FIG. 27 is a flow chart showing the processing steps of the central processing unit of a printer including the heads shown in FIG. 24.

When receiving print instructions from the host processor, the central processing unit 44 executes the processing steps shown in FIG. 27 per each color and per each head chip. Thus, the boundary K is to be shifted according to a print object. In the central processing unit 44, the control is moved from SP1 to SP2, and a judgement is made whether or not an image of a print object is character data. If the answer is "Yes", the central processing unit 44 moves to SP3 and an image of the print object is scanned, and in the subsequent step SP4, the area allocated to the overlapped area is detected by the scan result.

Subsequently the central processing unit 44 moves to the step SP5, and, in the overlapped area, the unit detects the dot print area where no ink droplet needs to be adhered (That is, a white area for a relevant color ink). In the subsequent step SP6, the central processing unit 44, by detecting the continuous area in the paper feed direction based on the white area detected in this way, detects a space area between characters as shown in FIG. 26 (A). The boundary K is set within the area, and the processing ends in the subsequent step SP7.

Thus, the central processing unit 44 performs the processing such that even if the characteristics of adjacent head chips are different, the boundary is set appropriately in the area where the difference of the characteristic becomes unnoticeable. After the boundary is set, the central processing unit 44 controls the head drive unit 50 such that the head chip is driven according to the setting pattern of the corresponding nozzle.

Figure 28:
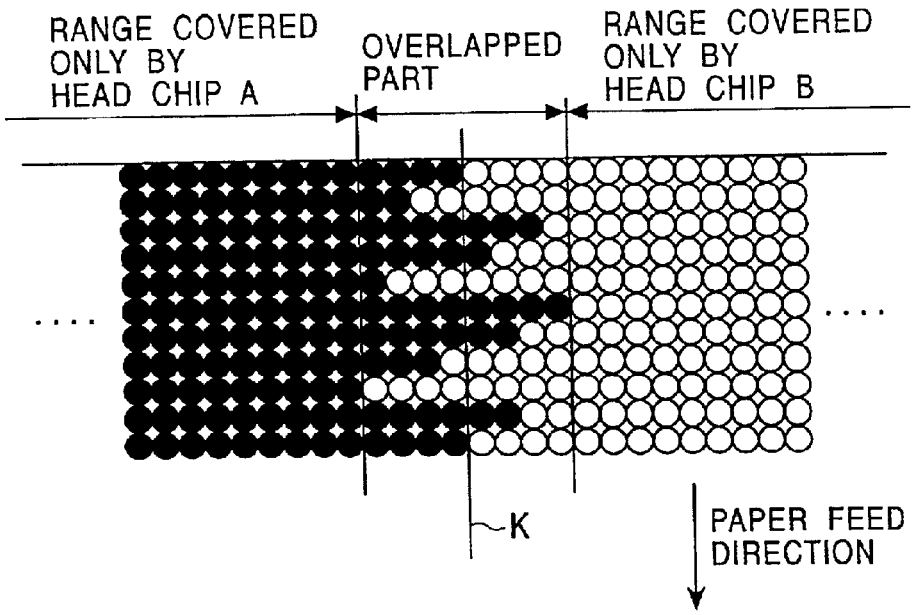
FIG. 28 schematically illustrates the case that the boundary is to be changed appropriately by random numbers.
Figure 29:
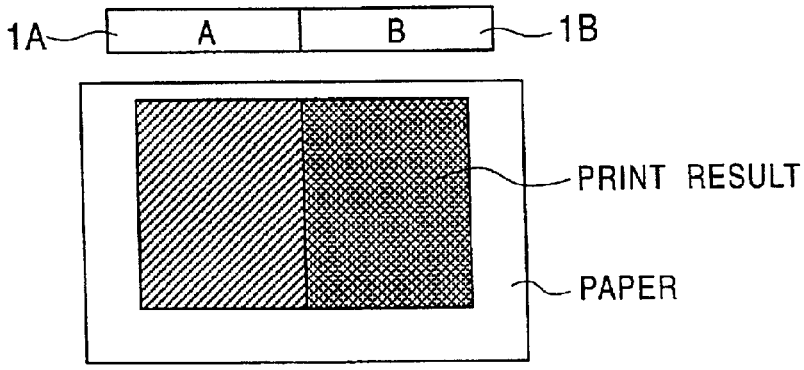
FIG. 29 schematically illustrates a print result by adjacent head chips having irregular characteristics.
Figure 30:
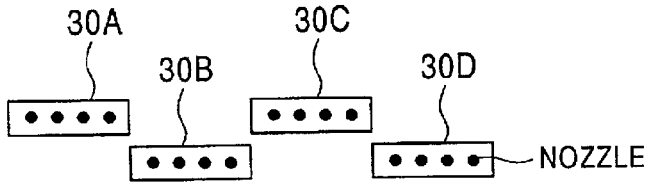
FIG. 30 schematically illustrates deterioration of the print result due to misplacement of head chips.
Figure 31:
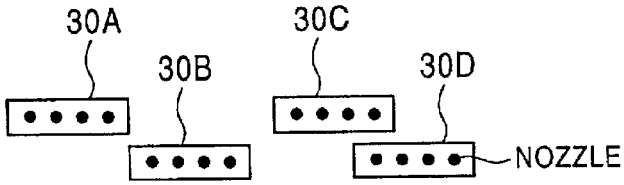
FIG. 31 schematically illustrates deterioration of the print result due to misplacement of head chips.
Figure 32:
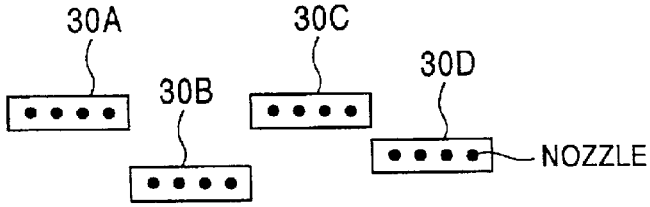
FIG. 32 schematically illustrates deterioration of the print result due to misplacement of head chips.
Figure 33:
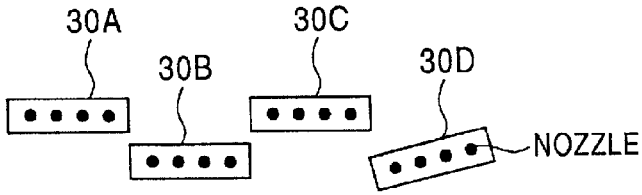
FIG. 33 schematically illustrates deterioration of the print result due to misplacement of head chips.

On the other hand, if the answer at the step SP2 is "No", the central processing unit 44 moves to the step SP8. In this step, the central processing unit 44 sets the actions of the drive unit 50 to drive the head chip according to the predetermined pattern, and then moves to the step SP7 to end the processing. Moreover, when the driving is performed according to the pattern mentioned in the above first to sixth embodiments, as shown in FIG. 28, there is a case where the boundary K is shifted appropriately using random numbers.

In the seventh embodiment, by setting the boundary and shifting it appropriately, the same effects can be obtained as the above-mentioned embodiments.

(8) The Other Embodiments

In the seventh embodiment mentioned above, the boundary is set between characters. The present invention is not limited to this embodiment, but can be widely applied to shifting the boundary according to a print object. Furthermore, when a print object includes vertical stripe pattern, the boundary can be set to the edge of such a stripe.

Also, in the above embodiments, the cases are described where no consideration is taken on the color of ink. The present invention is not limited to the embodiments, but can be widely changed, in consideration of the ink colors which are adhered to the same spot, mixing dots of each inks, and setting the boundary. In this way, it is possible to make it even more difficult to notice quality deterioration of print result.

In the above embodiments, the present invention has been described for driving adjacent head chips in one kind of mixing method and the boundary setting method. However, the invention is not limited to the described embodiments, but can be applied to, for example, dot-mixing method according to a print object, and adaptively setting the boundary method.

In the above embodiments, the present invention has been described for the case that a plurality of head chips are sharing the same part of material for creating nozzles, but can be applied to the case where each head chip individually has its own material.

In the above embodiments, the present invention has been described for applying it to a line printer using thermal method, however, the invention is not limited to the described embodiments, but can be applied widely to a line printer using piezoelectric-element driven method instead of heater-driven method.

As described above, with the present invention, the first or the second problem mentioned above can be solved respectively. This means that, as viewed from the direction of feeding a print object, the nozzles allocated to a head chip are placed in such a way that they are partly overlapped with the nozzles of adjacent head chips, thereby making it possible to prevent quality deterioration of the print result caused by head chips having irregular characteristics. Also, a nozzle array including a plurality of nozzles is made on one thin plate to form a nozzle plate, on which head chips are placed corresponding to the nozzle array to form a printer head. Moreover, nozzle arrays including the nozzles are made for a plurality of colors on one plate to form a nozzle plate, on which a plurality of head chips are placed corresponding to the nozzle arrays. Thus, it is possible to prevent quality deterioration of print result, such as deterioration of registration and reproducibility in color due to positioning error of head chips.

What is claimed is:

1. A printer, comprising:

at least one ink-ejecting mechanism, the at least one ink-ejecting mechanism having a printer head;

at least one head chip formed on the printer head, the at least one head chip being formed in an array pattern on the printer head; and a plurality of nozzles formed within a plurality of nozzle arrays positioned on a nozzle plate, each nozzle array corresponding to a different color wherein nozzles associated with one nozzle array and nozzles associated with an adjacent nozzle array partly overlap along at least one direction to form an overlapped area on a print object such that when the at least one ink-ejecting mechanism drives across the print object the nozzles of the one nozzle array and the nozzles of the adjacent nozzle array respectively eject inks which are mixed in the overlapped area to reduce dot density differences on the print object, wherein each nozzle array is arranged at an angle with respect to a horizontal direction so that adjacent nozzles in each nozzle array are shifted sequentially in a direction that is parallel to a paper feed direction, and wherein the horizontal direction is perpendicular to the paper feed direction.

2. A printer according to claim 1, wherein the nozzles are placed on the nozzle plate almost as wide as the print object to form the nozzle array in a direction perpendicular to the feeding direction of the print object.

3. A printer, comprising:

an ink-ejecting mechanism, the ink-ejecting mechanism having a nozzle plate;

a plurality of head chips formed on the nozzle plate, the plurality of head chips being formed in an array pattern on the nozzle plate; and a plurality of nozzle arrays formed on the nozzle plate within the array pattern, each nozzle array corresponding to a color wherein nozzles associated with one nozzle array and nozzles associated with an adjacent nozzle array partly overlap along at least one direction to form an overlapped area on a print object such that when the at least one ink-ejecting mechanism drives across the print object the nozzles of the one nozzle array and the nozzles of the adjacent nozzle array respectively eject inks which are mixed in the overlapped area at substantially the same point on the print object to reduce dot density differences on the print object, wherein each nozzle array is arranged at an angle with respect to a horizontal direction so that adjacent nozzles in each nozzle array are shifted sequentially in a direction that is parallel to a paper feed direction, and wherein the horizontal direction is perpendicular to the paper feed direction.

4. A printer according to claim 3, wherein the nozzles are placed on the nozzle plate almost as wide as the print object to form the nozzle array in a direction perpendicular to the feeding direction of the print object.

5. A printer head, comprising:

at least one ink-ejecting mechanism, the at least one ink-ejecting mechanism having a printer head;

at least one head chip formed on the printer head, the at least one head chip being formed in an array pattern on the printer head; and a plurality of nozzles formed within a plurality of nozzle arrays positioned on a nozzle plate, each nozzle array corresponding to a different color wherein nozzles associated with one nozzle array and nozzles associated with an adjacent nozzle array partly overlap along at least one direction to form an overlapped area on a print object such that when the at least one ink-ejecting mechanism drives across the print object the nozzles of the one nozzle array and the nozzles of the adjacent nozzle array respectively eject inks which are mixed in the overlapped area to reduce dot density differences on the print object, wherein each nozzle array is arranged at an angle with respect to a horizontal direction so that adjacent nozzles in each nozzle array are shifted sequentially in a direction that is parallel to a paper feed direction, and wherein the horizontal direction is perpendicular to the paper feed direction.

6. A printer head according to claim 5, wherein the nozzles are placed on the nozzle plate almost as wide as said print object to form the nozzle array in a direction perpendicular to the feeding direction of the print object.

7. A printer head, comprising:

an ink-ejecting mechanism, the ink-ejecting mechanism having a nozzle plate;

a plurality of head chips formed on the nozzle plate, the plurality of head chips being formed in an array pattern on the nozzle plate; and a plurality of nozzle arrays formed on the nozzle plate within the array pattern, each nozzle array corresponding to a color wherein nozzles associated with one nozzle array and nozzles associated with an adjacent nozzle array partly overlap along at least one direction to form an overlapped area on a print object such that when the at least one ink-ejecting mechanism drives across the print object the nozzles of the one nozzle array and the nozzles of the adjacent nozzle array respectively eject inks which are mixed in the overlapped area at substantially the same point on the print object to reduce dot density differences on the print object, wherein each nozzle array is arranged at an angle with respect to a horizontal direction so that adjacent nozzles in each nozzle array are shifted sequentially in a direction that is parallel to a paper feed direction, and wherein the horizontal direction is perpendicular to the caper feed direction.

8. A printer head according to claim 7, wherein the nozzles are placed on the nozzle plate almost as wide as the print object to form a nozzle array in a direction perpendicular to the feeding direction of the print object.

9. A printer comprising:

a printer head having first and second head chips;

first and second nozzle arrays, wherein each nozzle array comprises a plurality of nozzles, and wherein the first and second nozzle arrays are allocated to the first and second head chips, respectively; and a plurality of ink-ejecting mechanisms for ejecting ink droplets from a nozzle, wherein each ink-ejecting mechanism is associated with a nozzle, wherein some of the plurality of nozzles in the first nozzle array partly overlap a plurality of nozzles in the second array, as viewed in a print direction that a print object is fed into the printer with respect to the printer head, wherein each nozzle array is arranged at an angle with respect to a horizontal direction so that adjacent nozzles in each nozzle array are shifted sequentially in a direction that is parallel to a paper feed direction, and wherein the horizontal direction is perpendicular to the paper feed direction.

10. A printer comprising:

a printer head having first and second head chips;

an ink flow path in fluid communication with and located between the first and second head chips, wherein the first head chip is placed on a first side of the ink flow path and the second head chip is placed on a second side of the ink flow path opposed to the first side;

first and second nozzle arrays, wherein each nozzle array comprises a plurality of nozzles, and wherein the first and second nozzle arrays are allocated to the first and second head chips, respectively;

a plurality of ink-ejecting mechanisms for ejecting ink droplets from a nozzle, wherein each ink-ejecting mechanism is associated with a nozzle, wherein some of the plurality of nozzles in the first nozzle array partly overlap a plurality of nozzles in the second array, as viewed in a print direction that a print object is fed into the printer with respect to the printer heads, wherein each nozzle array is arranged at an angle with respect to a horizontal direction so that adjacent nozzles in each nozzle array are shifted sequentially in a direction that is parallel to a paper feed direction, and wherein the horizontal direction is perpendicular to the paper feed direction.

* * * * *